US006481889B2

(12) United States Patent
Delsahut

(10) Patent No.: US 6,481,889 B2
(45) Date of Patent: Nov. 19, 2002

(54) SEALED ENCLOSURE, METHOD FOR THE MANUFACTURE THEREOF, AND METHOD OF PACKAGING A BEVERAGE IN SAID ENCLOSURE

(75) Inventor: Alain Delsahut, Sainte-Savine (FR)

(73) Assignee: Walk Pak Holding N.V., Curacao (NL)

( * ) Notice: Subject to any disclaimer, the term of this patent is extended or adjusted under 35 U.S.C. 154(b) by 0 days.

(21) Appl. No.: 09/966,472

(22) Filed: Sep. 28, 2001

(65) Prior Publication Data

US 2002/0015541 A1 Feb. 7, 2002

Related U.S. Application Data

(62) Division of application No. 08/702,683, filed on Sep. 3, 1996, now abandoned.

(30) Foreign Application Priority Data

| | | |
|---|---|---|
| Mar. 3, 1994 | (FR) | 94 02575 |
| Aug. 5, 1994 | (FR) | 94 09882 |
| Oct. 28, 1994 | (FR) | 94 13159 |
| Mar. 3, 1995 | (WO) | PCT/IB95/00138 |

(51) Int. Cl.[7] ..... B65D 30/24
(52) U.S. Cl. ..... 383/44; 383/202
(58) Field of Search ..... 383/44, 202, 104, 383/208, 906

(56) References Cited

U.S. PATENT DOCUMENTS

| | | | | |
|---|---|---|---|---|
| 2,682,902 | A | 7/1954 | Metzger | 383/44 |
| 3,337,117 | A | 8/1967 | Lehmacher et al. | 383/202 X |
| 3,545,604 | A | 12/1970 | Gunther, Jr. | 383/202 X |
| 3,799,914 | A | 3/1974 | Schmit et al. | 383/104 X |
| 3,980,225 | A | 9/1976 | Kan | 383/104 |
| 4,454,979 | A | 6/1984 | Ikeda et al. | 383/104 X |
| 4,557,377 | A | 12/1985 | Maloney | 383/44 X |
| 4,806,021 | A | 2/1989 | Koudstaal et al. | 383/906 X |
| 4,898,477 | A | 2/1990 | Cox et al. | 383/104 X |
| 5,425,583 | A | 6/1995 | Wild | 383/202 |
| 6,076,968 | A | 6/2000 | Smith et al. | 383/202 |

FOREIGN PATENT DOCUMENTS

| | | | |
|---|---|---|---|
| AU | 0204022 | 12/1954 | 383/44 |
| CH | 0359659 | 2/1962 | 383/44 |
| EP | 306 207 | 3/1989 | |
| FR | 1122898 | 9/1956 | 383/44 |
| FR | 1128387 | 1/1957 | 383/44 |
| FR | 1 338 549 | 1/1964 | |
| FR | 1 512 330 | 4/1968 | |
| FR | 2 711 115 | 4/1995 | |
| GB | 0723588 | 2/1955 | 383/44 |
| GB | 0875848 | 8/1961 | 383/44 |
| GB | 1 001 873 | 8/1965 | |
| IT | 0529427 | 2/1958 | 383/44 |
| WO | 85/04849 | 11/1985 | |

*Primary Examiner*—Jes F. Pascua
(74) *Attorney, Agent, or Firm*—Henderson & Sturm LLP

(57) ABSTRACT

A sealed enclosure is provided with a valve at least part of which extends inside the enclosure and is formed between two flexible sheets extending between two opposed edges of the enclosure and being connected along two non-converging connection lines to define therebetween a duct upon spacing apart the flexible sheets from one another to allow the passage of a fluid between the inside and the outside of the enclosure. The sheets are arranged to be applied against one another upon ceasing of the application thereto of a force tending to hold them apart, thus preventing said fluid from leaving the enclosure. The sheets are sealingly connected to one another with each of the non-converging connection lines forming said duct at the opposite edges of the enclosure, the edges of the sheets adjacent to the inlet end of the duct being sealingly connected to the wall of the enclosure. Therefore, the opposed edges of the enclosure between which the flexible sheets extend are assembled to one another such that the corresponding edges of these flexible sheets situated between the edges of the enclosure are, on the one hand, assembled to one another, and on the other hand, to the adjacent edges of the enclosure. Also, the connection of the edge adjacent to the inlet end of the duct, of at least one of said flexible sheets, is constituted by an assembly.

6 Claims, 12 Drawing Sheets

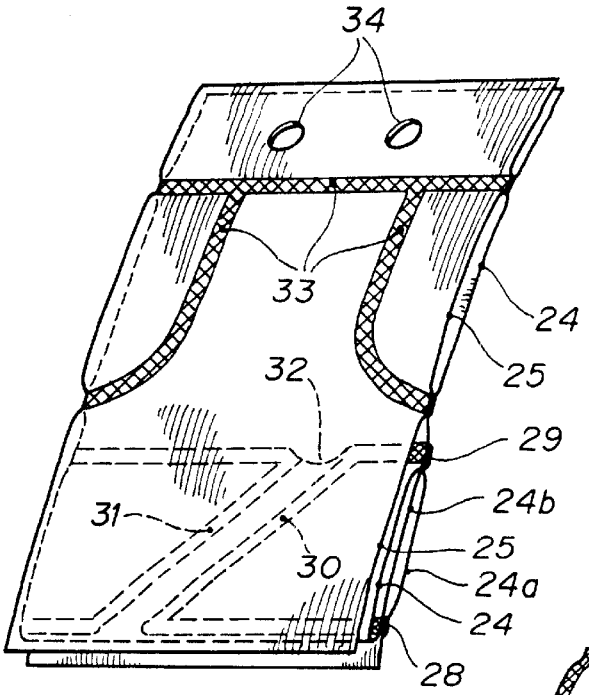
FIG. 3
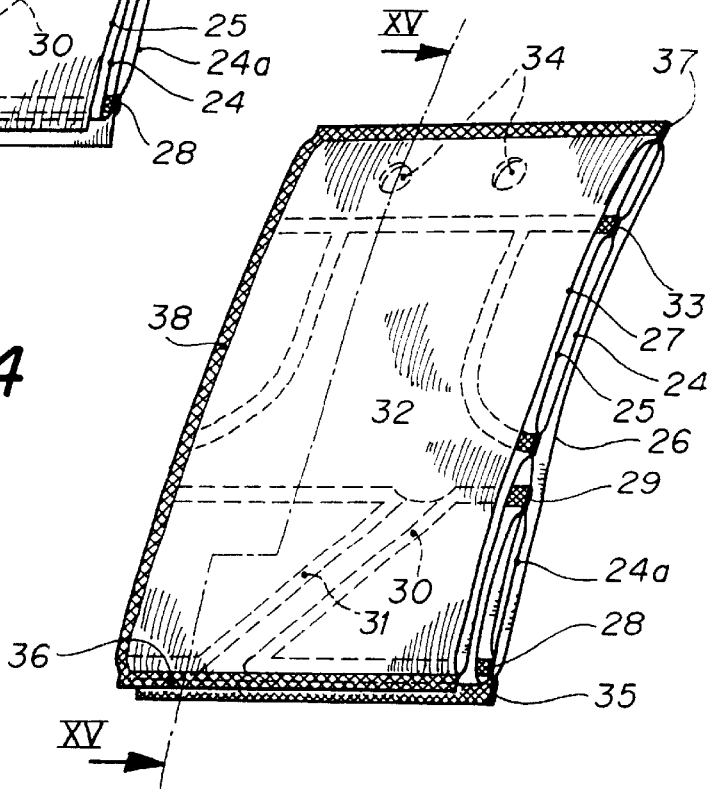
FIG. 4
FIG. 5
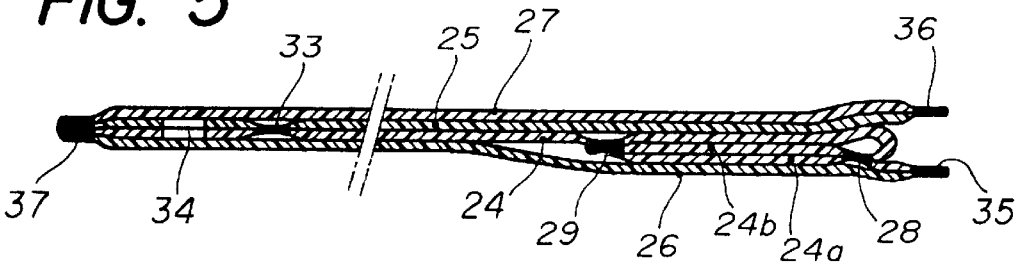

FIG. 20a
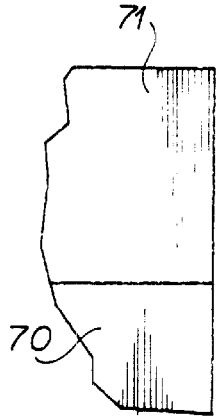
FIG. 20b
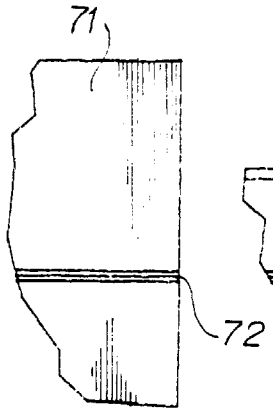
FIG. 20c
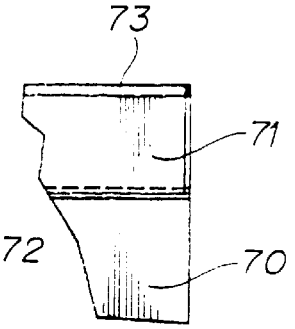
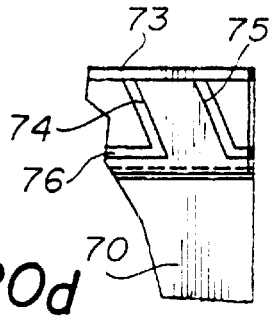
FIG. 20d
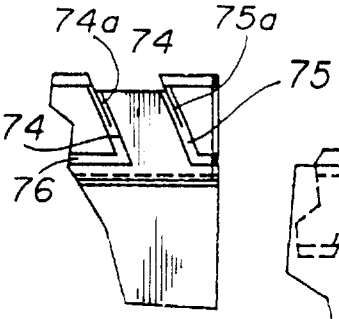
FIG. 20e
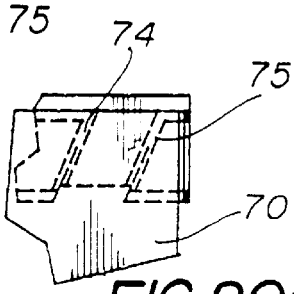
FIG. 20f
FIG. 21a
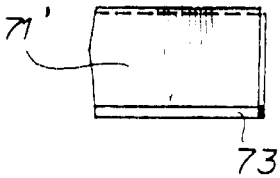
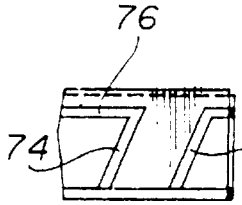
FIG. 21b
FIG. 21c
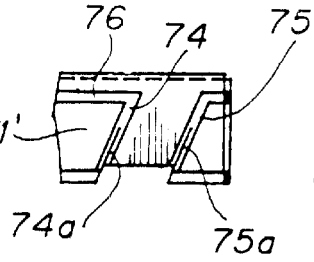
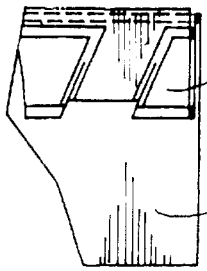
FIG. 21d

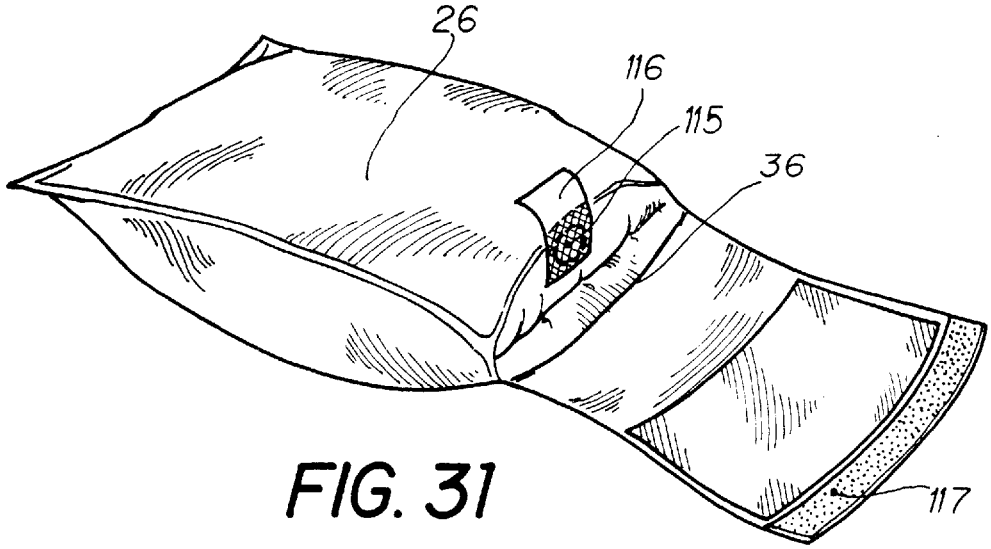
FIG. 31
FIG. 32
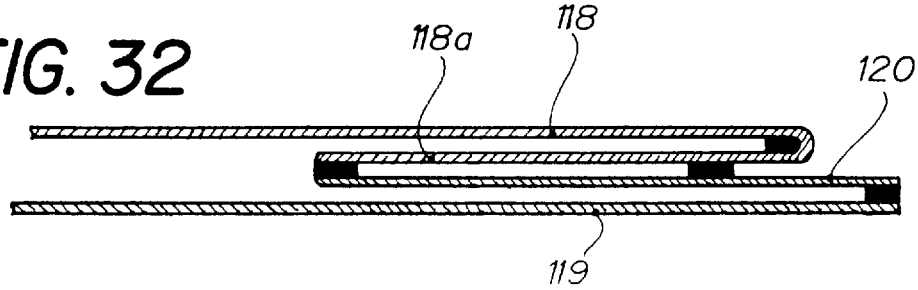

SEALED ENCLOSURE, METHOD FOR THE MANUFACTURE THEREOF, AND METHOD OF PACKAGING A BEVERAGE IN SAID ENCLOSURE

CROSS-REFERENCE TO RELATED APPLICATIONS

This application is a Divisional of U.S. patent application Ser. No. 08/702,683, filed Sep. 3, 1996, now abandoned the disclosure of which is being incorporated herein by reference in its entirety.

BACKGROUND OF THE INVENTION

1. Field of the Invention

The present invention relates to a sealed enclosure provided with a valve at least part of which extends inside the enclosure and is formed between two flexible sheets connected along two non-converging lines to form therebetween a duct upon spacing apart said flexible sheets from one another to allow the passage of a fluid between the inside and the outside of the enclosure, said sheets being arranged to be applied against one another upon ceasing of the application thereto of a force tending to hold them apart, thus preventing said fluid from leaving the enclosure. This invention also relates to a method of manufacturing this enclosure as well as a method of packaging a beverage.

2. Description of the Prior Art

Sealed enclosures of this type have already been proposed, provided with a valve which is in extension of the enclosure's wall, thereby avoiding problems relating to securing a fitted-on valve. Such enclosures are described notably in GB 826,784 and FR 1 338 549. The latter document proposes to make the enclosure out of a tubular element. This solution has the drawback of necessitating folding over the tubular element in order to place the valve inside the enclosure. This solution does not lend itself to be manufactured using automated mass-production lines that generally include folding, welding and cutting stations.

As for GB 826,784, its principal drawback resides in the fact that, in case the enclosure is used for packaging a beverage, the beverage must be introduced via the valve's orifice which necessarily is of small section because it is designed for the passage of a drinking straw. Because of this, the speed of filling the enclosure is necessarily reduced due to the small section of the passage, which limits the speed of the production line. Such a solution is evidently not economically viable.

Another drawback is that this enclosure is not adapted to be produced using machinery which is known, available or adaptable to the production thereof.

The aim of the present invention is to at least partly remedy the above-mentioned drawbacks.

BRIEF SUMMARY OF THE INVENTION

This invention concerns a sealed enclosure of the above-mentioned type. It also concerns a method of packaging a beverage in this sealed enclosure. Lastly, it concerns a method of manufacturing the sealed enclosure.

An advantage of the proposed solution is to enable the sealed enclosure to be manufactured with its valve integrated in a single wall of the enclosure, which enables use of existing production lines starting with a flat plastic film. When the enclosure is for packaging beverages, the enclosure can be filled at a high rate via an orifice which is of much greater section than the valve.

BRIEF DESCRIPTION OF THE DRAWINGS

The accompanying drawing shows, schematically and by way of example, several different embodiments and variations of the sealed enclosure, as well as the methods of manufacture thereof according to the present invention.

FIGS. 1 to 4 are perspective views illustrating different production steps of one embodiment of enclosure.

FIG. 5 is a cross-section along line XV—XV of FIG. 4.

FIGS. 20A to 20*f* are partial views of a variation of the embodiments of FIGS. 1 and 2 or 7 and 9.

FIGS. 21*a* to 21*d* are partial view of another varied embodiment.

FIG. 31 is a perspective view of a variation of FIGS. 4 and 5.

FIG. 32 is a cross-sectional view of a last varied type of the sealed enclosure.

DETAILED DESCRIPTION OF THE INVENTION

Figure 1:
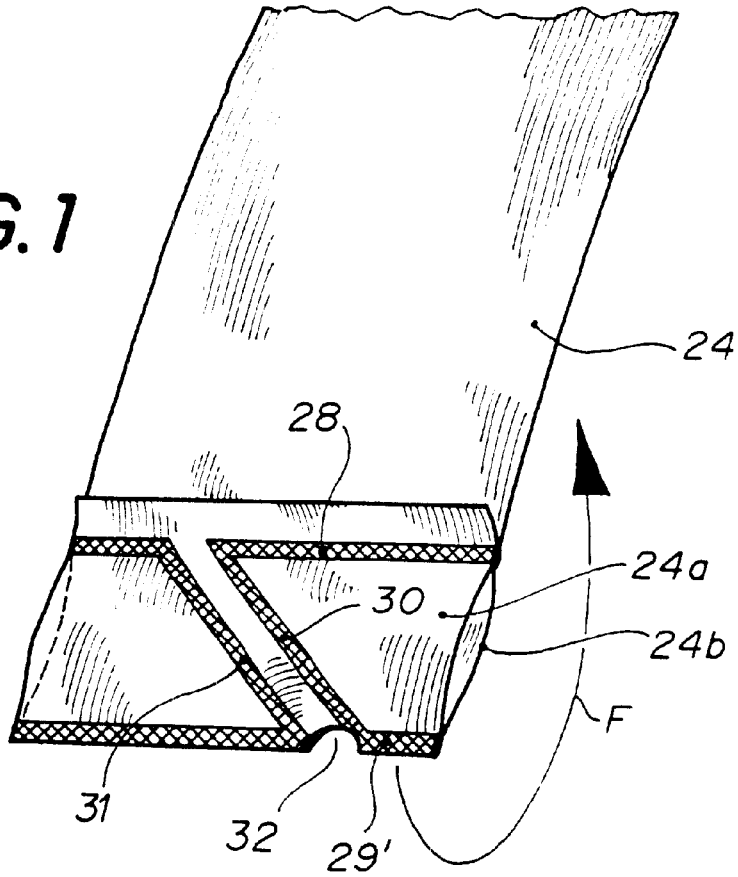

As shown in FIG. 1, to start with a sheet 24 is folded a first time to form a strip 24*a*. Preferably simultaneously, welds 28 and 29' are made as well as two oblique parallel welds 30 and 31 extending from one weld 28 to the other 29' to form the valve. For this purpose, the welds 28 and 29' stop short between the welds 30 and 31. Then, a cut-out 32 is provided in the first fold between these welds 30 and 31 to form a traversing passageway therebetween. The weld 28 stops a given distance away from the free edge of the strip 24*a*.

Figure 2:
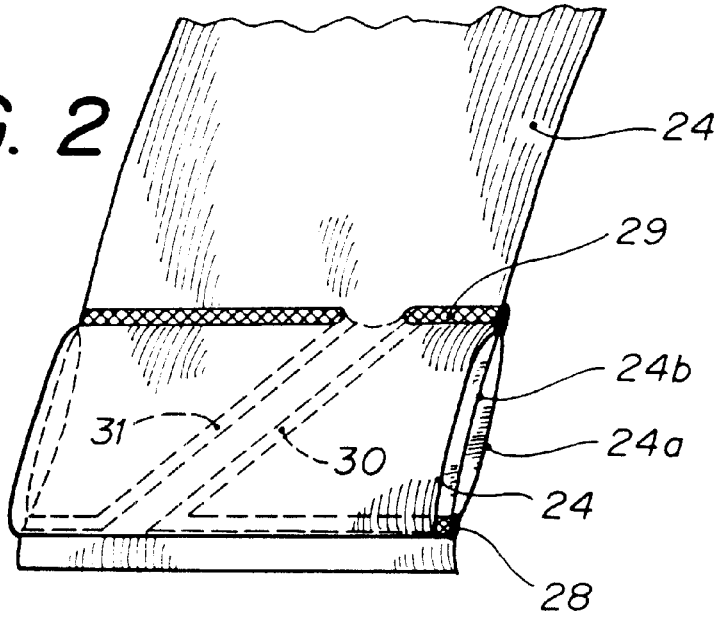

The sheet 24 is folded over again adjacent the weld 28 (in the direction of arrow F—FIG. 1) to form a strip 24*b*, and the weld 29' is fixed to the sheet 24 by a new weld 29 (FIG. 2) which now connects together the three thicknesses of the sheet 24. Like the initial weld 29', this new weld 29 stops between the valve's oblique welds 30, 31.

Then, sheet 25 (FIG. 3) is placed onto sheet 24 and these sheets are welded together to form a pocket between these sheets, on the one hand, and welds 33, on the other hand, to receive an object to be packaged. Preferably, the lateral edges of this pocket, closed by the welds 33, flare out to facilitate positioning of the object in the pocket. The sheets 24 and 25 thus form the inside wall of the sealed enclosure. Two openings 34 are then formed, for a purpose to be described later.

Then, two sheets 26,27 are placed respectively on the sheet 24 and on the sheet 25 (FIG. 4). A weld 35 is formed between one edge of sheet 26 and the adjacent edge of strip 24*a*. A weld 36 is formed between the two adjacent edges of sheets 25 and 27 and another weld 37 is formed parallel to the previous ones between the adjacent edges of the four sheets 24,25,26 and 27 (FIG. 5). Then two further parallel welds are formed (one of which, 38, is visible on FIG. 4), extending along the two other edges of the sheets 24 to 27, hence finishing the container. Given that the four sheets 24 to 27 are welded together on three sides and two-by-two along the fourth side, and that the valve opens out between the sheets 24 and 26, if the sheets 24 and 25 were not pierced with openings 34, only the space between the sheets 25 and 26 could be inflated. These openings 34 thus serve to place the space between the sheets 25 and 27 into communication with the valve arranged between the strips 24*a*,24*b* of sheet 24.

In a variation, the enclosure, instead of having a sealed pocket between two double walls, could have a single wall, in other words it would comprise only the sheets 24 and 26, and sheet 24 would not be pierced by openings 34. Such an enclosure could serve for packaging a liquid, for example a beverage.

Due to the design of the container illustrated in FIGS. 1 to 4, the outer walls 26,27 may be made of different materials to those of the sheets 24,25. Consequently, the outer walls could, for example, be thicker. It would also be possible to envisage that the outer walls would be rigid or semi-rigid shells.

In the given examples, the enclosure's walls are weldable, notably by ultrasounds, and are based on polythylene (PE) or linear low density polytheylene (LLDPE), preferably constituted of stratified PE/X/PE, where X is constituted of an air-tight barrier such as polyethylene vinyl alcohol (EVOH), polyamide (PA) or oriented polyamide (OPA). Of course, welding could be replaced by gluing although this would be more complicated to implement. A PE/X/PE configuration enables welding onto both sides of the sheet.

It can also be noted that the weld lines 28 and 29 connecting the weld line 29' to sheet 24 are not indispensable. It has however been observed that these weld lines are useful in as much as they ensure proper positioning of the valve inside the enclosure during inflation. It has also been observed that it is preferable to connect the bottom of the pocket to the bottom of the enclosure. However, this expedient is also not indispensable and the sheets 24 and 25 could be interrupted level with the weld line 33 defining the bottom of the pocket.

Of course, apart from the sheets' folding lines which are straight in order not to create problems of wrinkling in the folded strips, the remainder of the enclosure's periphery may have a shape other than quadrangular. For this, it suffices to cut the sheets to the desired shape, before or after welding, whereby the weld lines follow this shape.

It should further be noted that the container according to FIGS. 1 to 5 could also be provided with a part extending out of the enclosure beyond at least one of the welds 35 or 36, this part being adapted to form a handle, for example, or to form a flap protecting access to the valve.

Figure 6:
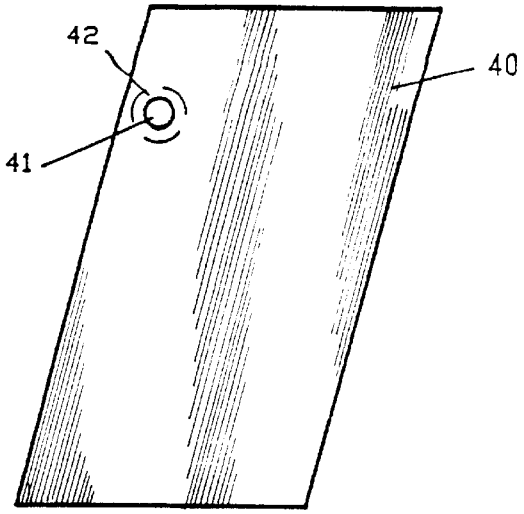
FIGS. 6 to 12 are perspective views illustrating different production and filling steps of the first embodiment.

FIG. 6 shows a quadrangular sheet 40 in which an orifice 41 has been pierced and covered with a cover 42.

This sheet 40 is cut from a roll which is unrolled while flat on a horizontal or vertical production line in a hydrogen peroxide bath in order to ensure aseptic treatment of the packaging material. Unwinding of the film or sheet takes place parallel to the welds from the top to the bottom of the sachet. The valve whose production will firstly be described is made in steps in the direction of unwinding of the coil of film.

Figure 7:
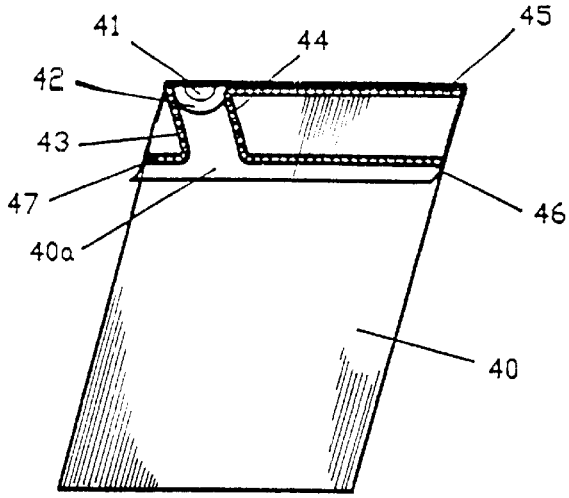

FIG. 7 shows this same sheet 40 of which a marginal strip 40*a* has been folded onto the front face of the sheet 40 level with the center of orifice 41. The marginal strip 40*a* is welded by two oblique parallel welds 43,44 limiting what will become the valve, and by welds 45,46,47 parallel to the folding line of the marginal strip 40*a* and connecting each end of the welds 43,44 or the two lateral edges of sheet 40.

Figure 8:
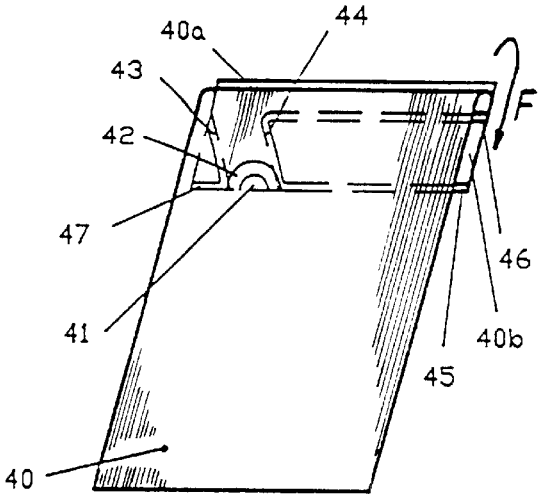

FIG. 8 shows the fold of the marginal strip 40*a* in the opposite direction (arrow F) relative to the part 40*b* of sheet 40 to which it has been welded.

Figure 9:
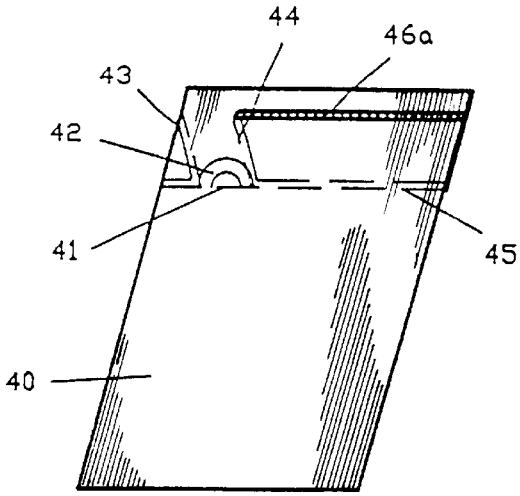

FIG. 9 shows the weld 46*a* of sheet 40 to the strips 40*a* and 40*b* along the same weld line as weld 46. The purpose of this weld 46*a* is to allow a drinking straw to be guided between the oblique weld lines 43,44 which define the valve.

Figure 10:
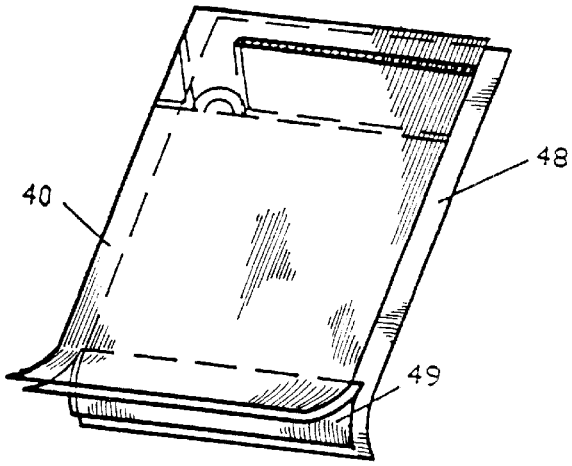

FIG. 10 shows the formation of a sachet which forms the sealed enclosure. In addition to the sheet 40 and the valve whose production steps have just been described, the sachet comprises a quadrangular sheet 48 of the same dimensions as the sheet 40 provided with its valve and a bellows-like folded part 49 designed to form the bottom of the sachet allowing it to be stood vertically on a horizontal surface.

To enable the folded part 49 to be welded to the lower ends of sheets 40 and 48 without the outer faces of the folded part becoming welded together, the folded part is made of a stratified material whose internal layer is a thermoplastic material, for example polyethylene whose external face is made of a thermo-hardenable material, for example OPA.

Figure 11:
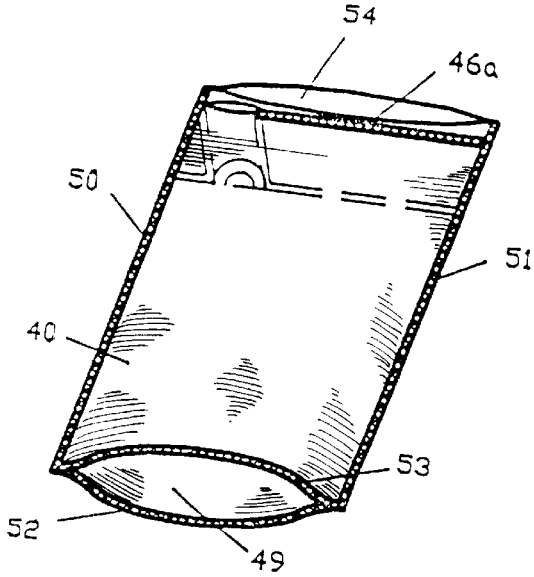

FIG. 11 shows two lateral welds 50,51 connecting together the sheets 40 and 48, and two bottom welds 52,53 connecting the folded part 49 to the sheets 48 and 40 respectively. However, the upper edge of the sheets 40 and 48 is not welded, leaving an opening 54 through which the enclosure can be filled.

Figure 12:
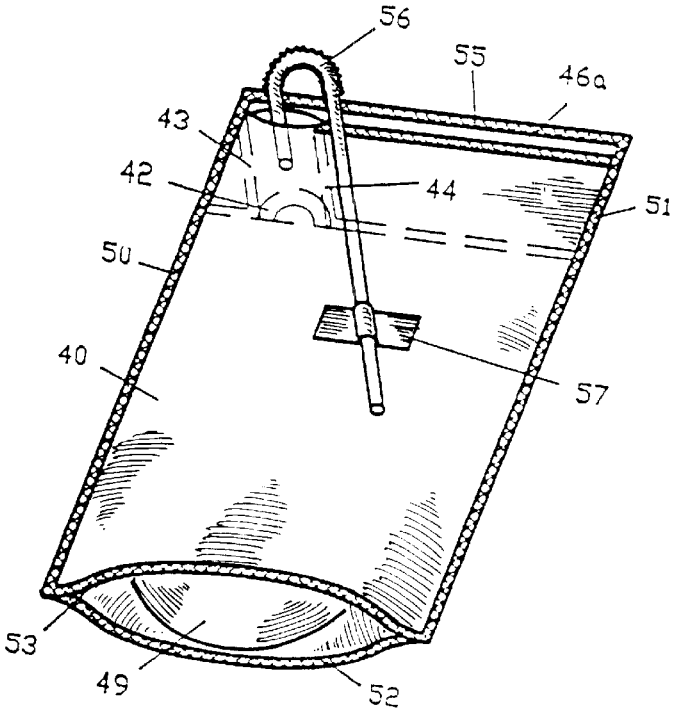

Finally, FIG. 12 illustrates the finished container with the upper edges of sheets 40,48 connected by a weld 55. A drinking straw 56 is engaged in the duct provided between the valve-forming welds 43 and 44 and is furthermore attached onto the outer face of sheet 40 by an adhesive type 57.

To consume the beverage, it suffices to remove the adhesive 57 to disengage the drinking straw 56 and push this into the inside of the enclosure by perforating the cover which may by a thin patch of aluminium. When the drinking straw 56 is removed, the two walls of the channel arranged between the welds 43 and 44 close again and, if the enclosure is turned upside down, the pressure exerted by the liquid hermetically closes the channel. As a variation, in place of the opening 41 and the cover 42 it is possible to replace the opening by a pre-cutting of the film 40.

From the preceding description, it can be seen that the production method enables a perfectly aseptic packaging of the beverage.

The embodiment of FIGS. 13 to 17 relates to the manufacture of sachets with bellows-like folded parts in the sides and which is designed to be produced on a production line having a machine axis parallel to the sachet's vertical axis. The valve must be so positioned that the folding operations are carried out continuously along the machine's axis. This constraint implies positioning the valve on a side part of the sachet.

Figure 13:
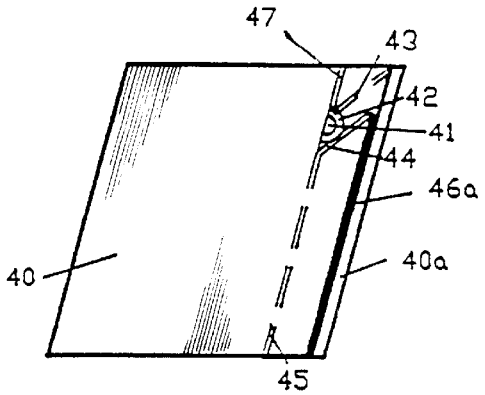
FIGS. 13 to 17 are perspective views illustrating different production and filling steps of the second embodiment.
Figure 14:
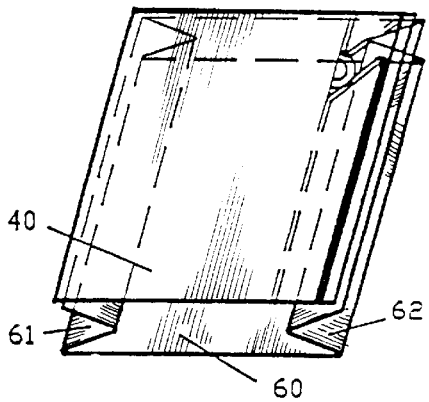
Figure 15:
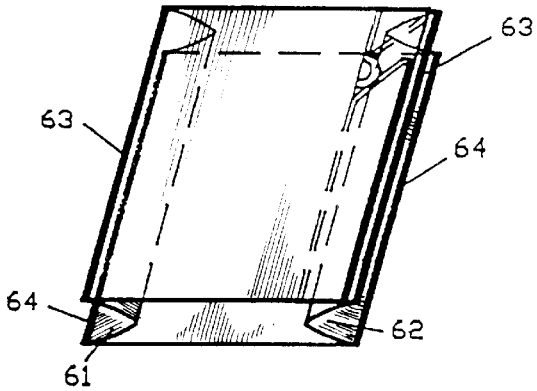

Apart from this difference, production of the valve shown in FIG. 13 corresponds in all respects to what is described and shown with reference to FIGS. 5 to 9. For this reason, the same reference numbers have been used for this part of the enclosure.

To make this enclosure, a sheet 60 is provided having the same dimensions as sheet 40 but having a bellows-like folded part 61,62 on each of its opposed lateral edges. Four welds are made (FIG. 15), two welds 61,62 to the sheet 40 and two welds 64 to rigidify the sachet.

Figure 16:
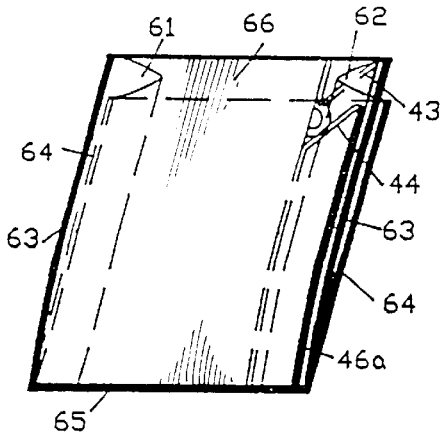

FIG. 16 shows the bottom-end weld 65 whereas at the top of the sachet an opening 66 is left for filling purposes. The sachet closed by a weld 67 (FIG. 17) can be placed on the bottom-end weld 65 which will flatten under the weight of the liquid, whereas the valve-forming channel provided between the welds 43 and 44 allows access to the beverage after perforating cover 42.

Figure 18:
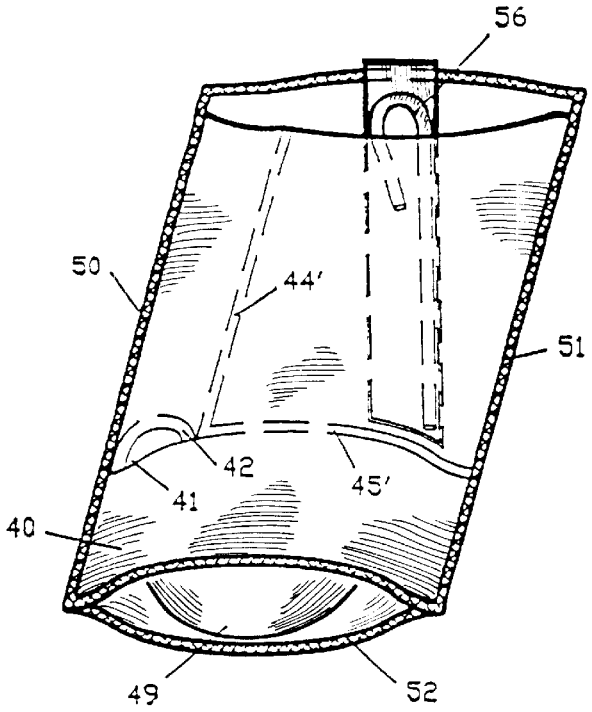
FIGS. 18 and 19 are perspective view of two variations of FIG. 12.
Figure 17:
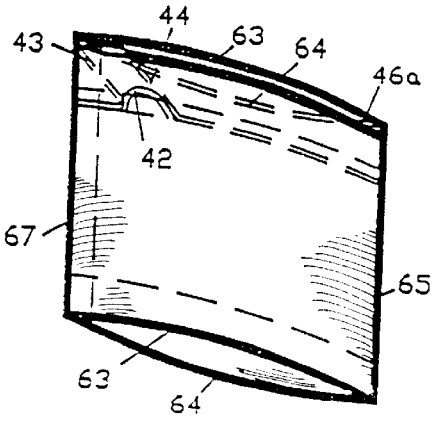
Figure 19:
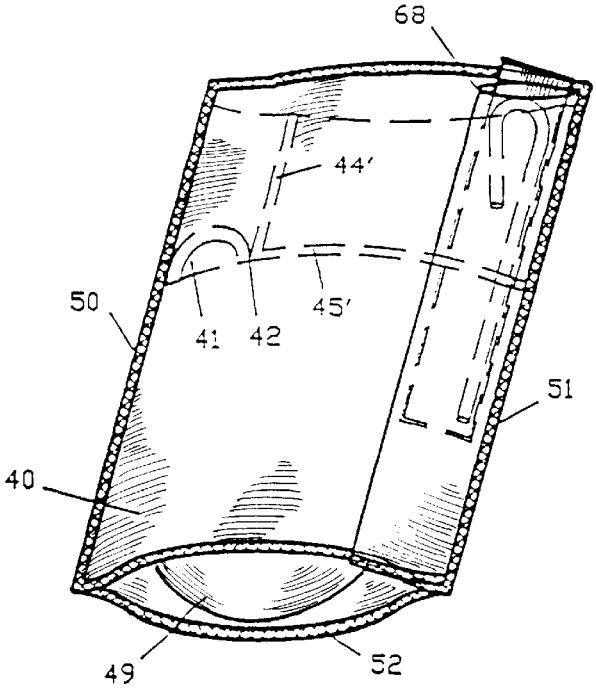
Figure 22:
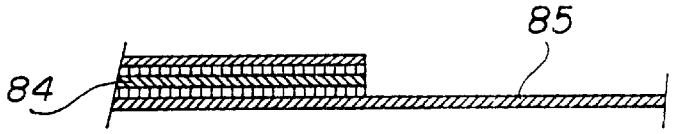
FIG. 22 is a cross-section of yet another variation.

The variation of FIG. 18 shows the sachet of FIG. 12 wherein the weld 46*a* has been dispensed with, and the valve channel provided between welds 44' and 50 (parallel to the edge of the sachet instead of oblique) is longer so as to form between the welds 44', 45' and 51 a pocket designed to receive a drinking straw 56. As the container formed by the sealed enclosure is designed specially to allow drinking the beverage several (subsequent) times, it is useful to provide a storage space for the drinking straw 56 which is required to penetrate into the enclosure through the channel formed between welds 44' and 50. The drinking straw containing pocket can be fitted with an adhesive-band type closure system arranged along its upper edge instead of the weld 46*a* of FIG. 12, or a closure device known under the Trademark Mini-grip®.

According to another variation, a pocket 68 can be provided in one of the sheets 40 or 48 forming a wall of the enclosure, which pocket serves to house a drinking straw.

The heretofore described sealed enclosure is made from a sheet forming at least one wall of the enclosure, in a marginal strip from which a valve is produced by folding and welding, as described above, which valve enables control of the flow of a fluid into or out of the sealed enclosure and to maintain the enclosure closed.

This embodiment necessarily presupposes that the sheet forming this wall of the enclosure and the valve are all made in the same material of the same thickness. However, to be able to close properly, the valve must be made of a very flexible material that is as thin as possible. On the other hand, it may be desirable for the enclosure wall to be thicker and preferably made of a stratified material such as PE/X/PE, where X is a gas-tight barrier such as polyethylene vinyl alcohol (EVOH), polyamide (PA) or oriented polyamide (OPA), whereas such a stratified material is not particularly suitable for the valve.

For this reason, it was envisaged to make the sheet 70 (FIG. 20) and the marginal strip 71 in two different thicknesses of the same material or different materials. Thus, the sheet 70 will be made in one of the above-mentioned stratified materials, whereas the marginal strip will be formed of a single layer of PE. This sheet 70 and this marginal strip are unwound from two spools and are arranged edge-to-edge (FIG. 20*a*) then welded together by a weld 72 (FIG. 20*b*). Then the marginal strip 71 is folded along the middle of its width (FIG. 20*c*). A weld 73 is made along the fold and two parallel welds 74,75 between the weld 73 and a weld 76 parallel thereto as in the previous embodiments, this weld 76 being interrupted between welds 74 and 75.

Next (FIG. 20*e*), the weld 73 is cut between the parallel welds 74,75 to form the channel and two cut-outs 74*a* and 75*a* are made in the middle of the width of welds 74,75. These cut-outs are designed to free a part of the length of the valve from the marginal strip 71 in which it is formed, which enables a better efficiency in the pressure exerted on the faces of the valve for the purpose of closing it, as explained previously. It should be noted that these cut-outs may advantageously also be made in the valves of the previous embodiments.

Lastly, the marginal strip 71 in which the valve is formed is folded over onto the rear face of the sheet 70 (relative to FIG. 20*e*), as shown in FIG. 20*f*, whereafter the enclosure is finished as in the preceding embodiments, by welding another identical sheet to the sheet 70 along the free edge of the marginal strip (FIG. 20*f*) and along the three sides of the sheet 70 non-adjacent to this free edge, hence closing the enclosure on four sides.

The variation of FIGS. 21*a* to 21*d* differs from the preceding one simply in that the valve, made of a material differing from that of the sheet 70', designed to form a wall of the sealed enclosure, is formed as previously by folding and welding before being secured to the sheet 70'. Starting from a separate strip 71' folded in two (FIG. 21*a*), a weld 73 is formed along the fold. Non-converging welds 74,75 are made, as well as a weld 76 connecting one of the ends of the non-converging welds to the transverse edge of the strip 71'. A cut-out is made between the welds 74,75 and the weld 73 of the strip (FIG. 21*c*), these cut-outs 74*a*,75*a* preferably being made part of the way along the welds 74,75. Then (FIG. 21*d*), one of the free edges of the strip 71' is welded to one edge of the sheet 70' and the enclosure is finished by welding a second sheet (not shown) at least in the case of a single-walled enclosure, as in the preceding embodiments. It is also of course possible to secure one or more bellows-like folded parts between the sheets, as previously described.

As another alternative to the embodiments of FIGS. 20 and 21, the same result can be achieved starting, as before, from a single multilayer sheet 84 having a different marginal part, for example a monolayer 85 in which the valve is formed as described previously.

Figure 23:
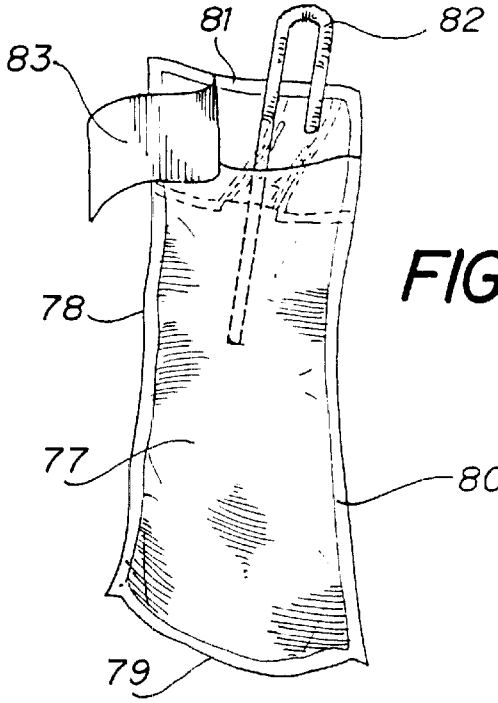
FIG. 23 is a perspective view of another variation of the embodiment illustrated in FIG. 18.

The embodiment of FIG. 18 proposes to provide a pocket to house therein a straw 56 for drinking the liquid contents of the enclosure. FIG. 23 illustrates a variation of this embodiment in which the single-walled enclosure with the valve is of the same type as in the embodiment of FIG. 11. However, this variation differs in that an external pocket is provided between an external wall of the enclosure and third wall 77 welded on three sides 78,79,80 to the corresponding edges of the enclosure, but stopping short a certain distance from the fourth side 81, thus enabling access to the inside of the pocket adapted to receive a drinking straw 82. The opening of this pocket is closed by an auto-adhesive tape 83 which extends from the edge 81 of the enclosure down to below the upper non-welded edge of the sheet 77. In this variation, the sheet forming the wall of the enclosure adjacent to the pocket may be the sheet forming part of the valve, similar to the valves of the previously described embodiments. Due to the fact that this wall is covered by the pocket-forming sheet 77 and by the adhesive tape 83, the sheet forming this wall and the valve may be made of a thinner material than that forming the other wall of the enclosure and the sheet 77.

Figure 24:
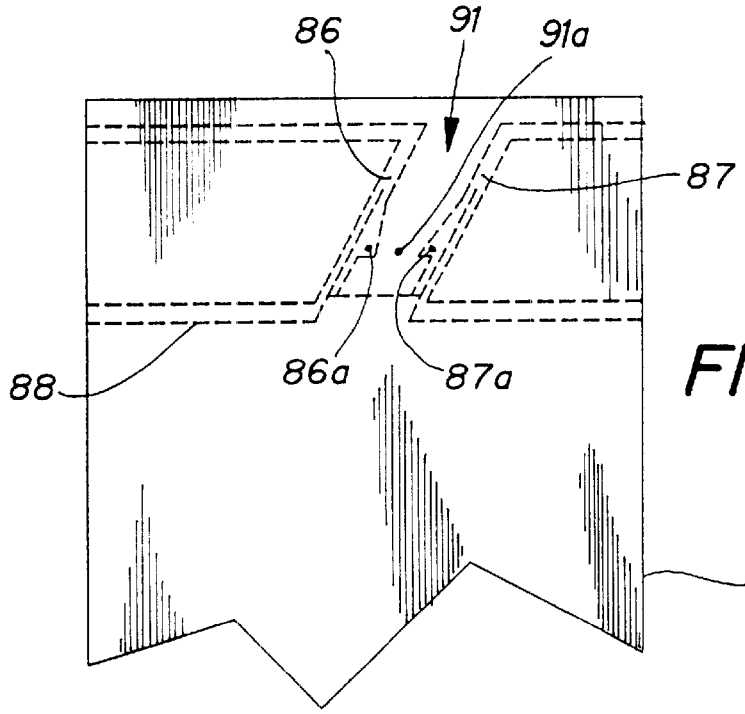
FIG. 24 is a plan view of a variation of the valve applicable to any one of the embodiments which serves as a packaging enclosure for a liquid.

The variation illustrated in FIG. 24 shows an enclosure 90 provided with a valve formed between two parallel welds 86,87 extending between two opposite edges of the enclosure 90. The parallel welds 86,87 are arranged in such a manner as to each form a progressive thickness 86*a*,87*a* in the valves channel 91, reducing the section thereof in funnel-like manner to a point where the welds 86,87 abruptly reassume their initial width. The large section of the thus-formed funnel is directed towards the exterior of the enclosure 90 and the smaller section is inwardly-directed. The ratio of the length of the entrance to the channel 91 and of the smallest section of the funnel, on the one hand, and of the smallest section 91*a* and the length of the end of the channel 91 leading into the enclosure 90, on the other hand, is about 2/3, 1/3. The purpose of this valve, whose channel 91 is divided into two parts, with their junction situated level with the smallest section of the funnel 91*a*, in the case of an enclosure for packaging a liquid, is to enable the drinking straw to be partly withdrawn above the level of the section 91*a* so it is left in the upper part of the channel 91, the lower part of the channel 91 closing even though the drinking straw is engaged in the upper part of the channel 91. Of course, this valve can be used in all of the previous embodiments designed for packaging liquids. The straw could also be replaced by a filling head, in particular for the packaging of liquid products other than beverages.

All of the previous embodiments have a cut-out 32,41 provided in the fold of the sheet between the parallel welds 30,31 or 43,44, etc. defining the valve channel. As a variation, in particular of the embodiments of FIGS. 20 and 21 where the valve is made in a material different to that of the enclosure walls, for the valve a very thin film can be used, which is not cut out or not pre-cut in a fold of the film, and is made of a material having elastomeric properties and a sufficient elasticity whereby it is not deformed in a non-elastic manner by the constraint resulting from placing the drinking straw in the channel, and is perforable by the drinking straw when it reaches the non-pierced bottom of the channel. Such a film can be made of polylefins such as terpolymers including ethylene, propylene and long-charrier dienic such as HIFAX XTR®, TECLAR®, ROYALENE® or TREFSIN®.

All of the described embodiments can be made from endless lengths of sheet material or films until sealed enclosures are obtained and can then be separated from one another. An advantage of this manufacturing method resides in the fact that the formation of the valve and the formation of the enclosure with two or four walls are both obtained by longitudinal folding and/or welding as the sheet material advances. Due to this, once the valve has been formed, if it is in another sheet material than that of the enclosure itself, it is integrated into the enclosure without previously being cut. This avoids having to position the valve, which is a complex operation that slows down the production rate and necessitates costly investments.

Figure 25:
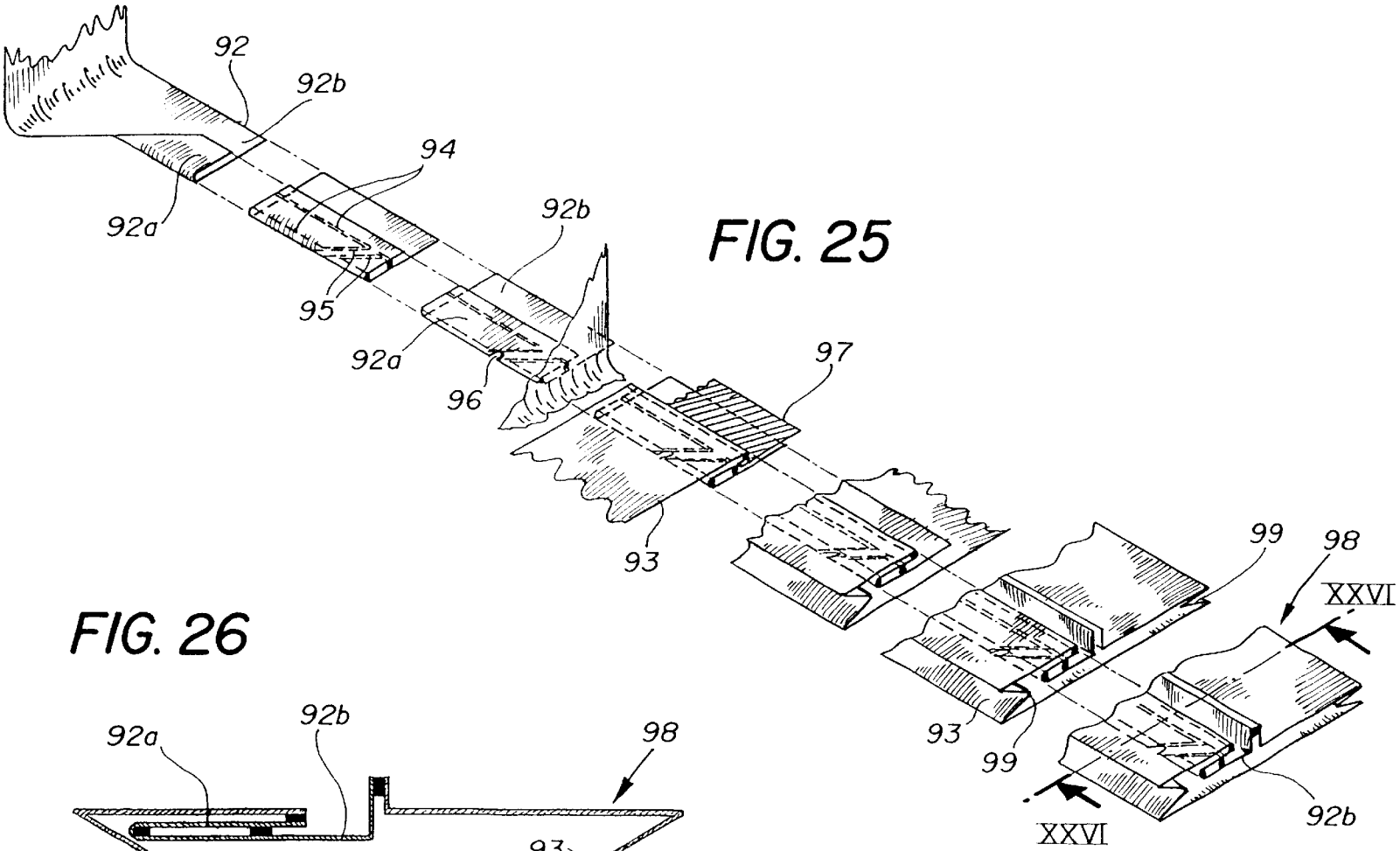
FIG. 25 is a perspective view illustrating a method of manufacturing a varied type of sealed enclosure according to the invention.
Figure 26:
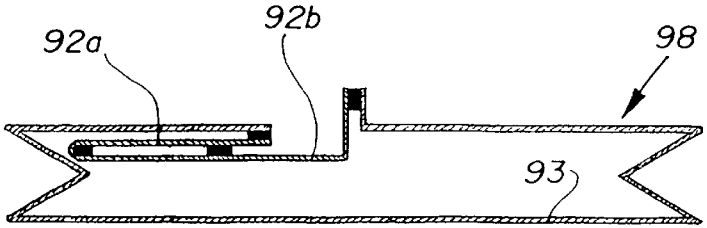
FIG. 26 is a cross-section of this varied enclosure along line XXVI—XXVI of FIG. 25.

FIG. 25 illustrates a method of manufacturing a sealed enclosure shown in cross-section in FIG. 26. This method is carried out continuously starting from two films 92 and 93 that are unrolled and folded and welded as they advance. The different steps of the method are illustrated by different cross-sections of the sheet materials, seen in perspective. However, it is emphasized that these cross-sections are given only to illustrate the various operations carried out, and the sheet materials are only cut when the sealed enclosure is completed. Firstly, one can see the film 92 for forming the valve. This film 92 is firstly folded longitudinally into two parts 92*a*,92*b*, of unequal width. These two parts are welded by two longitudinal welds 94 which are interrupted between two parallel oblique welds 95 for forming the valve's channel. In the following step, a cut-out 96 is made in the fold of sheet 92 between the two oblique welds 95.

The second film 93 for forming the sealed enclosure is unrolled in the next step, alongside the edge of the part 92*a* of the valve formed in film 92. A separator guide 97 is placed in the trajectory of film 92 and is arranged to be inserted between the parts 92*a*,92*b*. This separator 97 is arranged to allow the welding of the edge of the part 92*a* with the edge of film 93 without the part 92*b* being welded therewith.

In the following steps, the film 93 is formed to provide the enclosure 98 illustrated in cross-section by FIG. 26, with two lateral bellows-like folded parts 99. Lastly, the second longitudinal edge of film 93 is welded to the part 92*b* of film 92, after having folded their two longitudinal edges by 90°. Hence, this sealed enclosure has an access to the inlet of the channel formed between the two oblique welds 95 situated on a large face of the enclosure and not in the edge thereof, as was the case up to now.

Figures 27, 28:
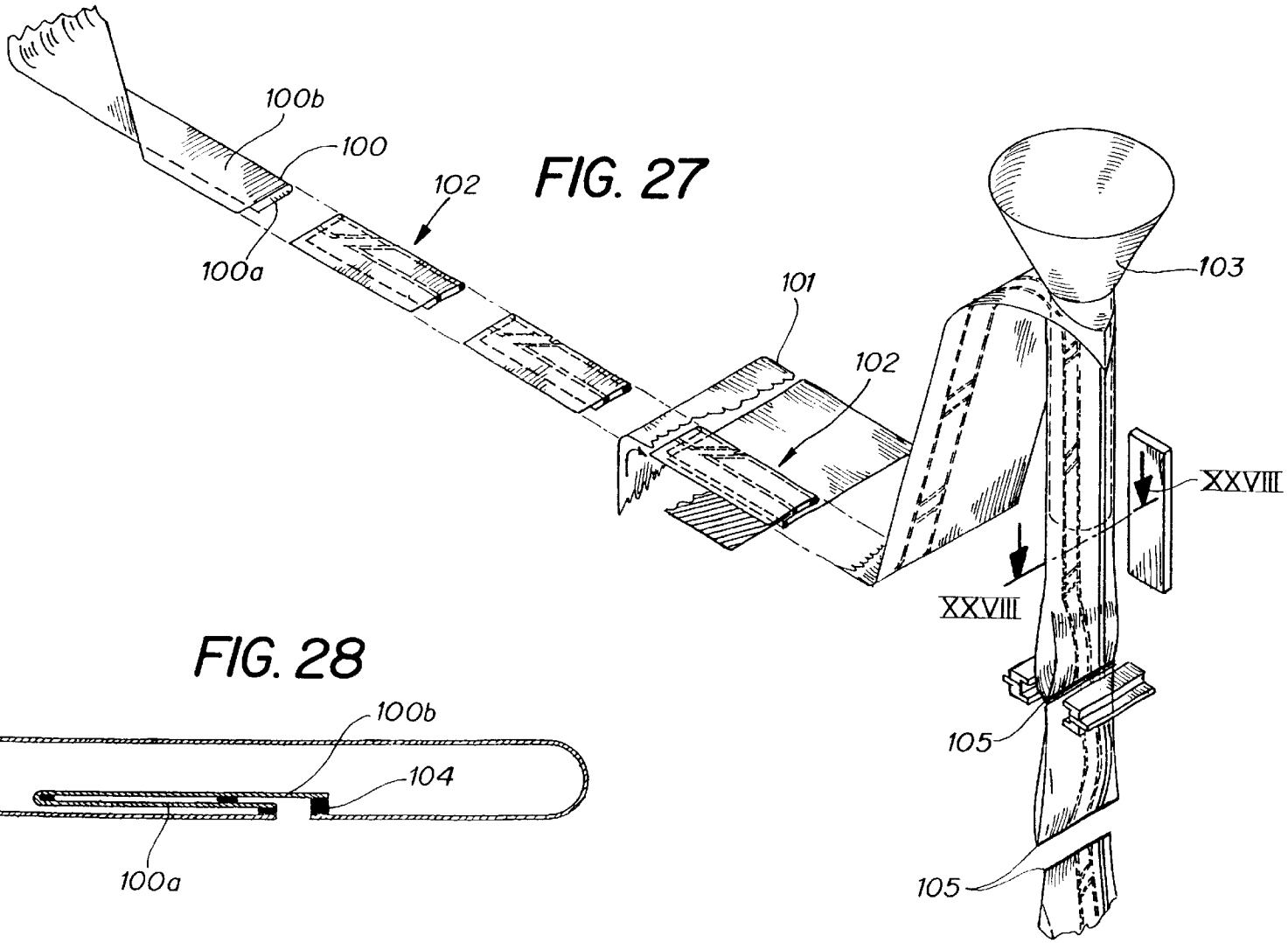
FIG. 27 is a perspective view of another variation of the method of manufacturing a varied type of sealed enclosure.
FIG. 28 is a cross-sectional view along line XXVIII—XXVIII of FIG. 27.

The variation illustrated by FIGS. 27 and 28 concerns a manufacturing method with which is associated a unit for filling the enclosure with a liquid product to be packaged in this enclosure. As in the previous example, one starts from two films 100,101 respectively to make the valve 102 in the same manner as before, by folding unequal widths 100*a*, 100*b*, the edge of the part 100*a* being welded to one edge of the film 101.

Then, the film 101 with valve 102 is made into a tubular shape about a filling hopper 103, and a longitudinal weld 104 (FIG. 28) is made between the edge of part 100*b* and the other edge of film 101, hence closing the tubular element formed about hopper 103. Transverse welds 105 are provided with a regular spacing as the tubular element moves forward. Between two transverse welds 105 a metered amount of a product to be packaged is poured into the hopper 103 and the thus-filled sachets are separated from one another along the middle of the width of the transverse welds 105.

Figure 30:
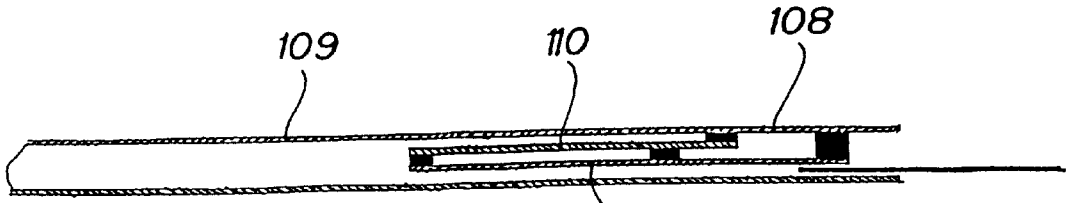
FIG. 30 is a cross-sectional view along line XXX—XXX of FIG. 29.
Figure 29:
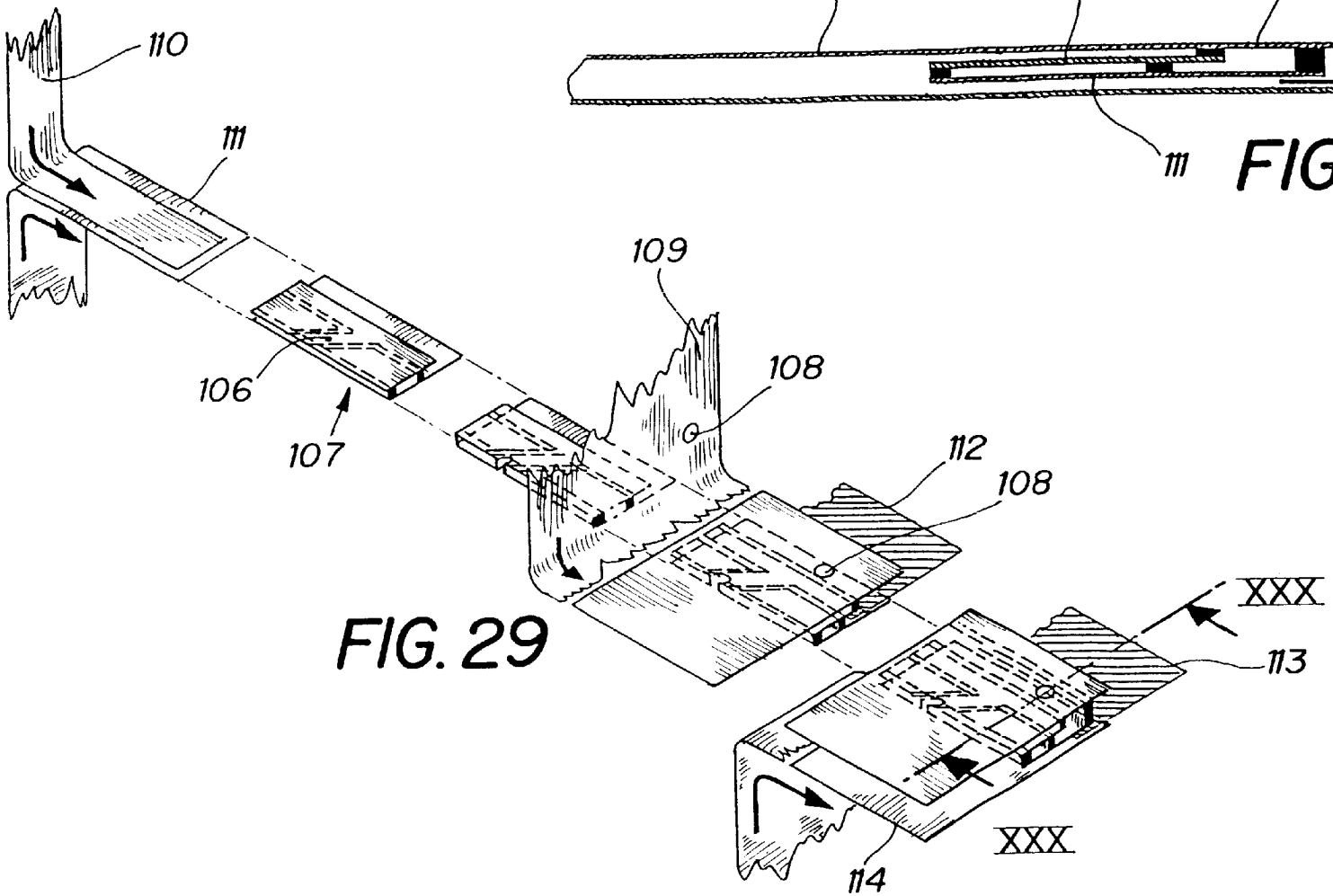
FIG. 29 is a perspective view of a last type of varied method of manufacture of another type of sealed enclosure.

FIGS. 29, 30, illustrate yet another method of manufacturing a sealed enclosure which is differentiated from the previously-described embodiments by the fact that access to the channel 106 of valve 106 is via an opening 108 cut in a film 109 adapted to form a wall of the sealed sachet. As shown in FIG. 29, instead of forming the valve by folding a sheet, the same result can be obtained by welding the adjacent longitudinal edges of two strips 110,111 of unequal width. These two embodiments of the valve are interchangeable and are at the choice of the manufacturer. Next, as can be seen from FIG. 29, the free edge of strip 118 is welded to the inner face of film 109, using a separator guide 112, then the free edge of the strip 111 is welded to the same inner face of the film 109 using another separator guide 113. The two free edges of the respective strips 110 and 111 are welded together on either side of the opening 108 hence allowing access to the channel 106 of valve 107. Finally, a film 114 is unwound and welded to the two longitudinal edges of film 109. Next, as in all of the preceding embodiments, the entire set of superimposed films (which in the example are only welded longitudinally with the exception of the channel 106) are welded transversally and cut along the middle of the width of the transverse weld to separate the sachets.

In the various embodiments of the method according to the invention described above, when it is desired to weld together not the entire thickness of all of the superimposed sheets but only some of these sheets, a separator is inserted between the films, made of a material that is non-weldable with the sheet material. As a variation, the separator may be replaced by a heat resistant varnish applied to the reverse side of a film whose front side is to be welded, whereby this varnish matches the shape of the weld or welds to be made on the side to be welded. In this manner, welding of the valve can be done at the same time as welding of this valve to the film forming the walls of the sealed sachet, by coating the film of the valve with a varnish at the place where the valve-forming welds are made. By way of example, the heat resistant varnish could be a polyurethane varnish or an acrylic varnish.

FIG. 31 shows a variation of the sealed sachet illustrated in FIG. 5. In this variation, the film 24 forming the valve 24*a*,24*b* is provided with a cut-away opening 115 obtained by a tongue 116 which is partly welded or stuck to the film 24 to hermetically close the opening 115. By grasping the non-welded part of the tongue 116, it can be pulled off to deflate the sachet.

This sachet also includes a flap 117 welded to the edge 36 and forming a pocket to receive a postal identification slip. This flap 117 normally covers the tongue 116 and adheres to the sheet 26 hence avoiding this tongue being pulled off unwantedly.

Lastly, FIG. 32 shows a final variation of the sealed enclosure in which the enclosure is formed of two films 118,119, the film 118 being folded to form one of the parts 118*a* of the valve, whose other part is formed by a film 120 welded like all of the previous valves to the part 118*a*. Finally, the free edge of the film 120 is welded to the adjacent edge of film 119. Thus, it has been demonstrated that: the valve can be integrated in a wall of the sealed enclosure as in the case of FIGS. 1 to 19; the valve can be made from a film which is separate from that of the sealed enclosure as in the case of FIG. 20; the valve can be made of a film welded to a folded film which is a wall of the sachet. In all of these cases, the valve is made continuously with the sealed enclosure and hence extends across the sachet between two opposite edges of this sealed enclosure.

It is obvious to the person skilled in the art that the above-described enclosure with its fluid-tight closure valve can be made with other types of machine and that other embodiments are possible within the scope of the invention defined by the claims.

What is calmed is:

1. A sealed enclosure provided with a wall and a valve which extends inside the enclosure and is formed in a marginal strip between two flexible sheets extending from one of two opposed edges of the enclosure to the other and being connected along two non-converging connection lines to define therebetween upon spacing apart said flexible sheets from one another, a duct having two ends, one of the two ends communicating with the inside, the other of the two ends with the outside of the enclosure, to allow the passage of a fluid between the inside and the outside of the enclosure, said flexible sheets being arranged to be applied against one another upon ceasing of the application thereto of a force tending to hold them apart, thus preventing said fluid from leaving the enclosure, edges of said flexible sheets adjacent to the end of said duct communicating with the outside of the enclosure, being sealingly connected to the wall of the enclosure, said opposed edges of the enclosure between which said flexible sheets extend, are assembled to one another such that the corresponding edges of these flexible sheets situated between the said opposite edges of the enclosure are assembled to one another, and assembled to the opposite edges of the enclosure, and said flexible sheets are furthermore connected one to the other by sealed connections from each of the two ends of the duct, delimiting said duct up to said opposite edges of said enclosure, said sealed connection adjacent to the end of said duct communicating with the outside of at least one of said flexible sheets being constituted by an assembly different from that of the adjacent edges of the enclosure, wherein said duct is formed in a marginal strip adjacent an edge of a sheet forming at least one of the walls of said enclosure, said marginal strip being folded about a folded line parallel to said edge of said wall, said non-converging connection lines extending from said folded line towards an opposing parallel edge of said marginal strip, two parts of said marginal strip thus folded over on one another being applied against one face of said wall with a free edge of the marginal strip situated substantially adjacent to respective adjacent edges of said wall and of said marginal strip, forming a second fold line between said wall and said strip, free edge of said strip as well as free edges of said wall being sealingly assembled to an adjacent edge of a second wall applied against the face of the first wall adjacent to said marginal strip in such a manner as to form said enclosure containing said folded over marginal strip.

2. A sealed enclosure according to either of claim 1, including a pre-cut-out made in the two flexible sheets in a zone situated between two assembly lines which is perforable by introduction of a rod between the assembly lines.

3. A sealed enclosure according to claim 2, wherein a cut-out orifice is made in a portion of the length of each of said assembly lines in the median part of their width starting from said folded edge.

4. A sealed enclosure according to claim 1, including a cut-out which interrupts the fold in the marginal strip in a zone extending between two assembly lines to allow the passage of a fluid in the thus-formed duct.

5. A sealed enclosure according to claim 1, wherein said marginal strip is formed by a strip welded to the edge of said sheet forming at least one of the walls of said enclosure, said strip and said sheet being made of two different materials.

6. A sealed enclosure according to claim 1, wherein said non-converging connection lines each have a progressive thickness flaring-part extending in the duct in the direction from the duct end communicating with the outside of the enclosure towards the duct end communicating with the inside of the enclosure, this flaring part abruptly terminating at a point intermediate the two duct ends, the duct being thus divided longitudinally into two portions, and external portion adapted to serve as receiving means of a tubular member and an internal valve-forming part whose opening is controlled by longitudinal displacement of the end of said tubular member from an external portion to an internal portion of said duct.

* * * * *